US006067665A

United States Patent [19]

DePalma et al.

[11] Patent Number: 6,067,665

[45] Date of Patent: May 30, 2000

[54] ADJUSTABLE PROTECTIVE COLLAR

[75] Inventors: Bernard F. DePalma, Ithaca; Dale L. Strauf, Homer, both of N.Y.

[73] Assignee: Cramer Products, Inc., Gardner, Kans.

[21] Appl. No.: 09/210,412

[22] Filed: Dec. 11, 1998

[51] Int. Cl.[7] ..... A41D 13/00

[52] U.S. Cl. ..... 2/468; 2/44; 2/462

[58] Field of Search ..... 2/468, 455, 456, 2/44, 102, 462, 410

[56] References Cited

U.S. PATENT DOCUMENTS

| | | | |
|---|---|---|---|
| 3,497,872 | 3/1970 | Mitchell | 2/44 |
| 3,855,631 | 12/1974 | Ettinger | 2/2 |
| 4,501,023 | 2/1985 | Bilberry | 2/44 |
| 4,590,622 | 5/1986 | Wolfe et al. | 2/2 |
| 4,821,339 | 4/1989 | Fair | 2/44 |
| 4,996,720 | 3/1991 | Fair | 2/44 |
| 5,483,698 | 1/1996 | Douglas | 2/2 |
| 5,715,541 | 2/1998 | Landau | 2/410 |

*Primary Examiner*—John J. Calvert
*Assistant Examiner*—Tejash Patel
*Attorney, Agent, or Firm*—Litman, Kraai, & Brown, L.L.C.; John C. McMahon

[57] ABSTRACT

A protective collar apparatus comprising a protective pad operably positioned behind the neck of a user, a torso mounted vest and a pair of flexible and non stretchable connecting straps joining the pad to the vest. An adjustment strap is also joined to the pad and is adapted to be looped around shoulder pads or the like. The adjustment strap allows selective tilting and positioning of the pad. The pad is crescent shaped and has a front side constructed of soft material and a rear side constructed of stiff material. The pad is shaped to cradle the head or helmet when the head is pushed rearwardly relative to the torso of the player.

15 Claims, 4 Drawing Sheets

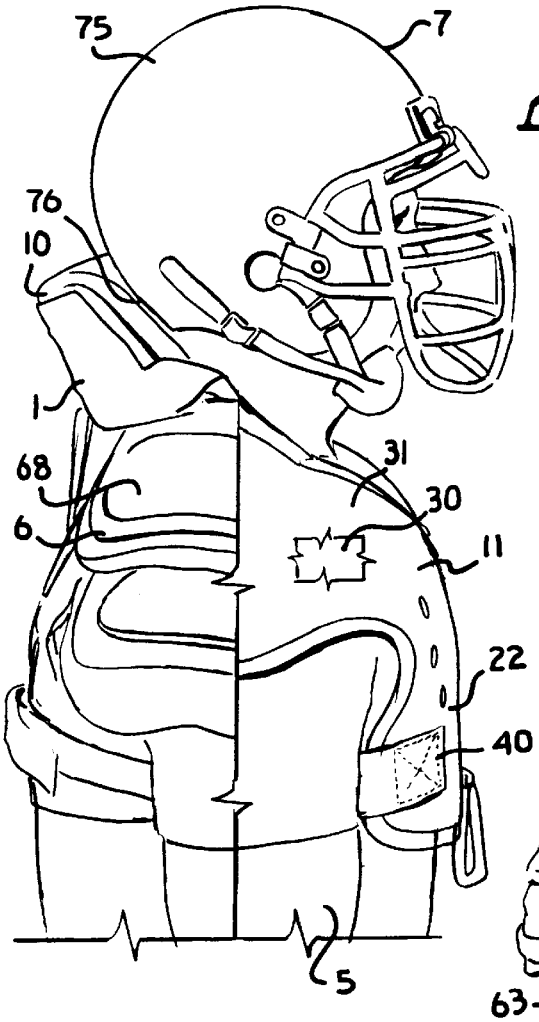
Fig. 6.
Fig. 7.
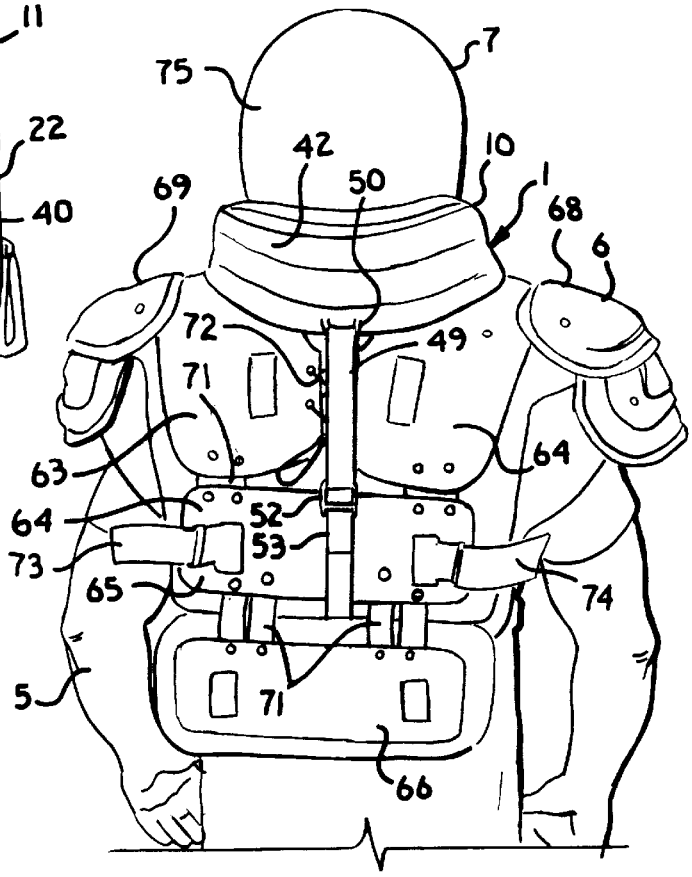

ADJUSTABLE PROTECTIVE COLLAR

BACKGROUND OF THE INVENTION

The present invention is directed to a protective collar used in certain athletic games, especially American football, to reduce the risk of neck injury to the user and, in particular, to such a collar that is adjustable and protects the wearer both with respect to rearward and sideways blows to the head.

Dangerous neck injuries are always a possibility to athletes engaged in contact sports. American football players are especially prone to neck injuries, because the head is often pushed rearwardly or sideways by impacts or blows, especially tackling, that overextend the neck with substantial force and may cause injury to the cervical vertebrae, ligaments, muscles, nerves and most importantly the spinal cord.

Various collars are currently in use to help prevent such neck injuries. One such collar was invented by Fair and is illustrated in U.S. Pat. Nos. 4,996,720 and 4,821,339. The purpose of the Fair collars are to cushion and absorb energy from blows to the head, especially that drive the head rearwardly.

The purpose of the present invention is to provide a collar that allows improved function over that of the Fair collars and other prior art devices. In particular, the Fair collars attach directly to a supporting vest entirely along the underside of each collar.

Direct attachment prevents adjustment of the tilt of the collar relative to the vest. It has been found that certain players, such as linemen who must play in a "down" position with at least one hand on the ground prior to start of a play, prefer to be able to bring their heads further rearward to be able to see their opponents better, as compared to other players who start in a standing stance, such as football linebackers. Preferably, a player can somewhat easily adjust the collar, even during breaks in play, to provide the most comfortable support for the player, without the player having to remove the entire apparatus.

Furthermore, the prior art devices of Fair connect the foam that forms the protective collar directly to the vest across the entire bottom of the collar. Such direct collar to vest connection tends to be weak and it wears heavily, so that such collars tend to wear out comparatively quickly.

Another problem associated with the prior art collars results from the direct connection of the vest to the collar along the entire underside of the collar. In particular, when the athlete wearing this device receives a blow to the torso, the vest often rides upwardly on the body. This in turn causes the vest to push against the collar which may jam the collar against or beneath the player's helmet or position the collar such that it causes more harm than good, especially if the player is delivered a second blow to the head. Therefore, it is desirable that the apparatus be constructed so that the vest holds the collar in position when forces are applied to the collar, but also that the vest does not displace or jam the collar, when upward forces are applied to the vest.

Many of the prior art collars, such as Fair, are designed to cushion blows, but not significantly limit range of movement. In order to protect persons having hyperextension with or without side flexion that cause injuries often referred to as burners, it is necessary to limit range of motion. Limitation of the range of motion of the head and neck is often helpful to persons that are susceptible to such injuries or who are otherwise at risk of such injuries.

Finally, it has been found that it is important for the helmet of football players to be received in a cradle or pocket that absorbs lateral side flexion, extension and twisting forces on the head and neck and thereby reduces the likelihood of injury due to blows to the side of the head. The present invention allows the support collar to be position adjusted while still also providing a cradle for the helmet.

SUMMARY OF THE INVENTION

The present invention provides a protective collar apparatus for use by a football player and other athletes receiving blows to the head to reduce the risk of injury. The apparatus has a vest adapted to be worn on the torso of a user and a protective collar.

The collar is constructed of shock absorbing material such as foam that is covered with a fabric layer. The collar is joined to the vest by a pair of connecting straps that are positioned on either side of the neck and which both hold the collar in a helmet receiving position and also transfer a portion of the force applied to the collar during a blow to the vest. The connecting straps are preferably constructed of a fabric material which has good wear characteristics. The straps are relatively non-stretchable so that the collar is held in place by the vest when forces are applied to the collar, but the straps are also very flexible and easily collapsed when forces are applied to the vest, so that upward forces acting on the vest do not displace the collar.

The collar is shaped to fit about the helmet, or head if a helmet is not used, and includes a curved indention or pocket to specifically cradle the helmet or head so as to resist lateral side flexion/sideways and extension by the helmet and head.

The rear of the collar is not directly attached to the vest, but rather is connected by the flexible connecting straps. An adjustment strap is provided to position the collar to provide for greatest comfort and protection of the user. The adjustment strap is preferably secured to both the collar and to shoulder pads or other structure, such as the vest. The adjustment strap allows the collar to be held in different rotational or tilting positions relative to the head wherein the collar rotates about the connection thereof with the connecting straps.

In particular, the collar is rotated about an axis generally passing through the attachment of the connecting straps to the collar. While the shoulder pads and other equipment somewhat lift the collar and bias the collar against a helmet or the user's head, the adjustment strap allows a user to select different positions for the collar depending on the needs of the user. The collar is biased upward by the back of the player and the shoulder pads against the resistance of the adjusting strap. The adjusting strap includes a quick adjustment mechanism that allows for relatively quick readjustment of the length of the adjusting strap should the player change positions or simply need to change the collar position to better fit the players needs without requiring the player to remove the collar apparatus or shoulder pads.

OBJECTS AND ADVANTAGES OF THE INVENTION

Therefore the objects of the present invention are: to provide a protective collar apparatus that includes a vest and a collar for reducing the risk of neck injuries to athletes using the apparatus; to provide such an apparatus wherein the collar is easily adjusted for use by players playing different positions and such that the collars can be adjusted relatively quickly without removing the apparatus; to provide such an apparatus wherein the collar includes a pocket to cradle a helmet and reduce the likelihood of twisting, side to side movement and extension during a blow; to provide such an apparatus wherein the collar is joined to the vest by a pair of comparatively long lasting connecting straps such that the apparatus is functional for a comparatively long time; to provide such an apparatus wherein the collar is connected in such a manner that the vest holds the collar in a preferred position, especially against blows, but does not transmit upward movement of the vest to the collar; to provide such an apparatus having an adjustable positioning strap adapted to be secured to shoulder pads or the like for allowing the collar to be held in a plurality of different positions; to provide such an apparatus having an adjusting apparatus that allows comparatively quick modification of the position of the collar without removal of the apparatus; and to provide such an apparatus that is easy to use, comparatively inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is a side elevational view of a player wearing the collar apparatus, shoulder pads and a helmet with part of the shoulder pads broken away to show underlying detail.

FIG. 7 is a rear elevational view of a player wearing the collar apparatus with the shoulder pads and helmet.

DETAILED DESCRIPTION OF THE INVENTION

Figure 1:
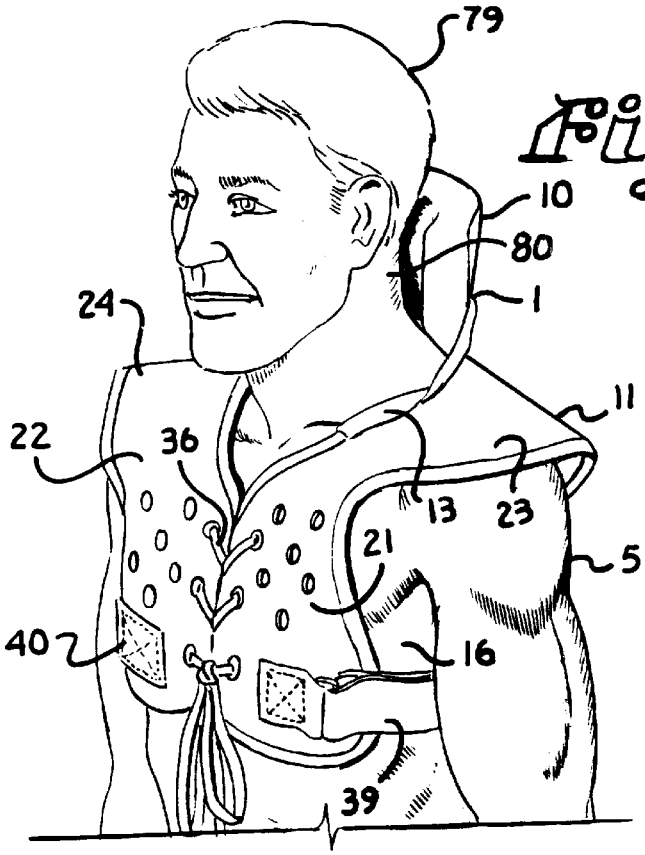
FIG. 1 is a perspective view of a protective collar apparatus in accordance with the present invention, shown positioned on a user.
Figure 2:
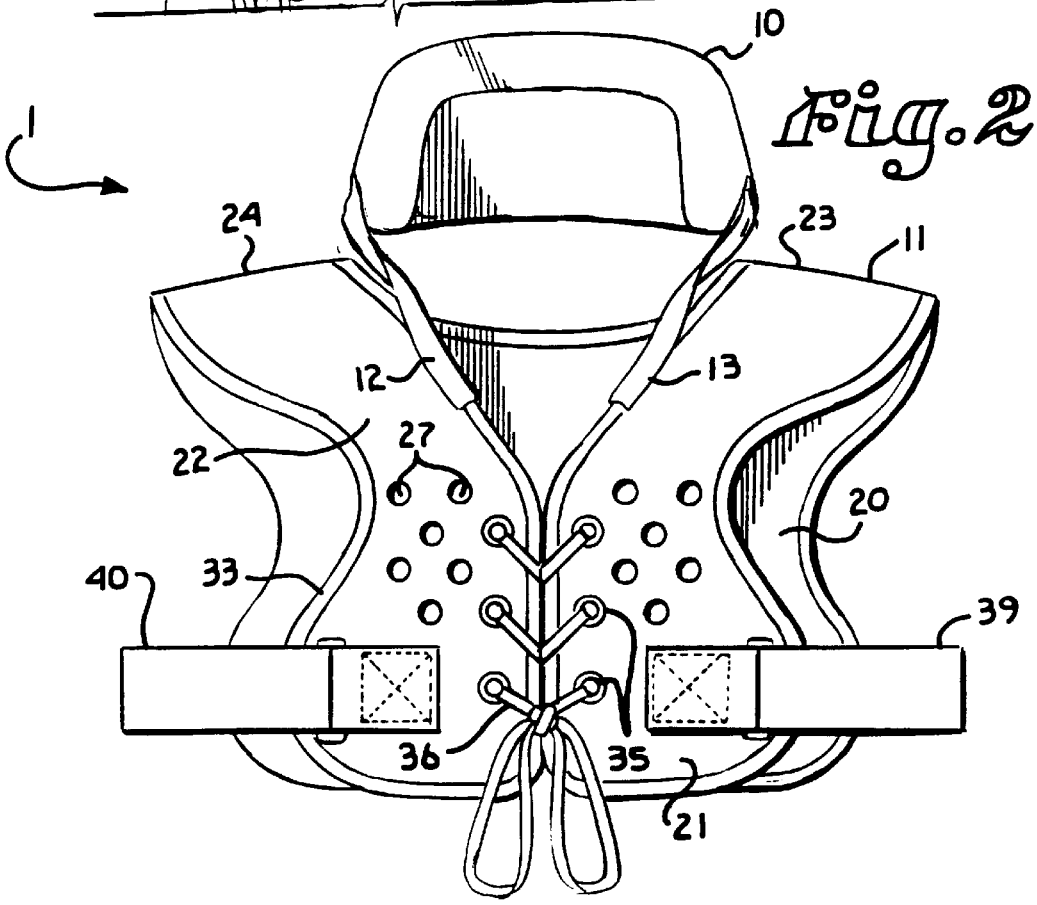
FIG. 2 is a front elevational view of the collar apparatus.
Figure 3:
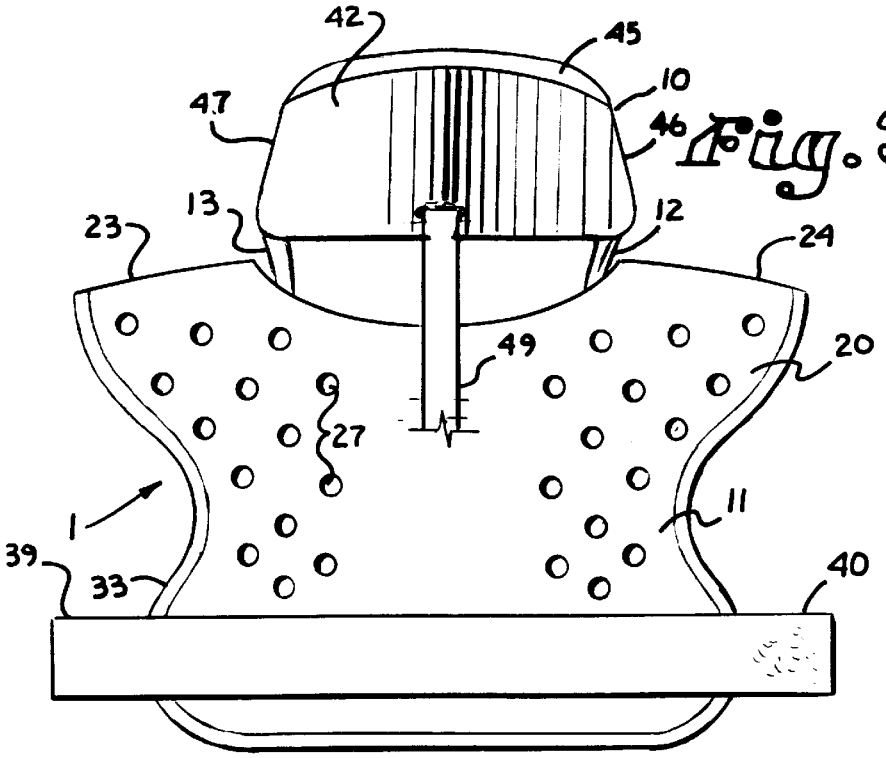
FIG. 3 is a rear elevational view of the collar apparatus.
Figure 4:
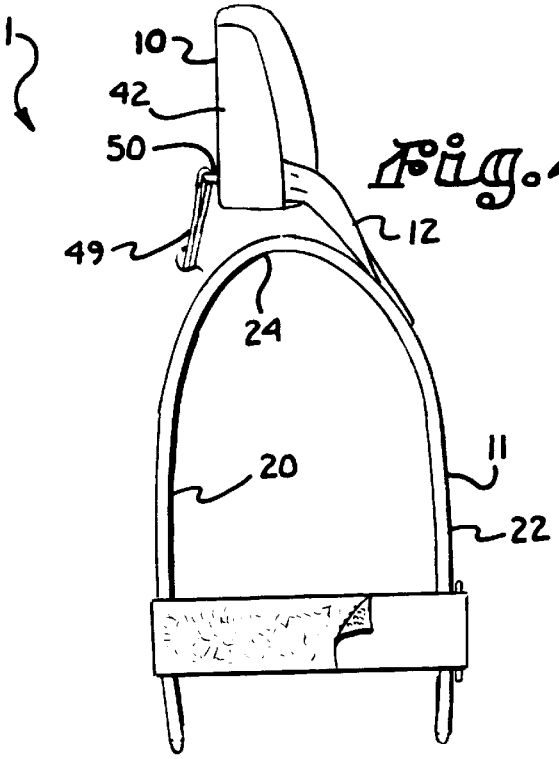
FIG. 4 is a side elevational view of the collar apparatus.
Figure 5:
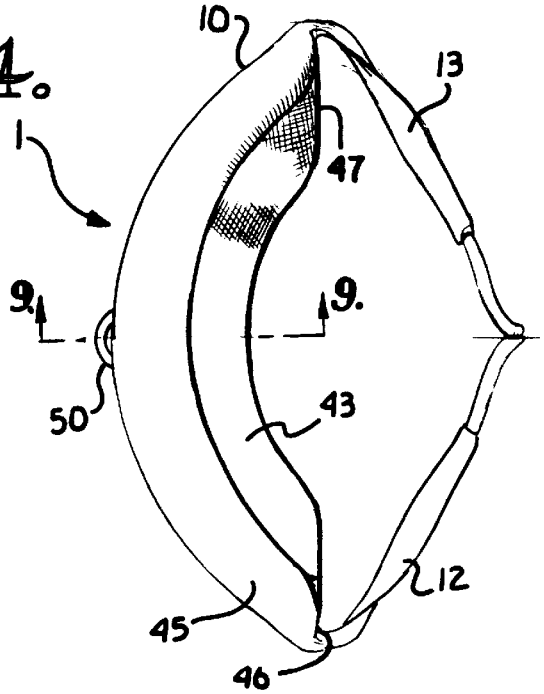
FIG. 5 is a top plan view of a collar portion of the collar apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a protective collar apparatus in accordance with the present invention shown in use on a player 5, also wearing shoulder pads 6 and a helmet 7.

The protective collar apparatus 1 includes a protective collar or pad 10, a vest 11 and a pair of connecting right and left straps 12 and 13 joining the vest 11 to the protective pad 10.

The vest 11 is designed, sized and shaped to be worn on an upper torso 16 of the player 5. The vest 11 has a rear panel 20, a left front panel 21, a right front panel 22 and shoulder sections 23 and 24 integrally joining the left front panel 21 and the right front panel 22 to the rear panel 20. The front panels 21 and 22 and the rear panel 20 include a plurality of breathing apertures 27 to make the vest 11 more comfortable to wear.

The vest 11 functions as an anchor structure to anchor the pad 10 to the torso 16 of the user. The vest 11 is constructed of an inner foam layer 30 covered by a woven fabric layer 31 such as nylon. All of the edges of the vest 11 are covered by a woven fabric strip 33 that is stitched to the layers 30 and 31 to protect the edges, to provide additional strength to the vest 11 and to function as an anchor for the straps 12 and 13.

The vest has a series of grommets 35 extending along adjacent sides of the left front panel 21 and right front panel 22 which threadably receive a lace 36 similar to a shoelace to operably secure together the left front panel 21 and right front panel 22.

A pair of joining straps 38 and 39 that join in the rear connect the left front panel 21 and right front panel 22 respectively to the rear panel 20. The straps 38 and 39 are secured to the rear panel 20. The joining straps 38 and 39 are adjustable in length and allow a player 5 to adjust the vest 11 to snugly fit the player's torso 16.

The protective pad 10 has an irregular shape, but is somewhat C-shaped or crescent shaped when viewed from the top. The pad 10 has a curved rear surface 42, a curved front surface 43 that is adapted to receive and cradle the helmet 7, a bottom surface 44 that normally rests on the shoulder pads 6 (FIGS. 6 and 7), a top surface 45 and side surfaces 46 and 47.

The protective pad 10 includes an adjustment strap 49 that is positioned through a loop 50 that is secured to and projecting from near the bottom and horizontal center of the pad rear surface 42. The adjustment strap 49 is constructed of a flexible and generally non-stretchable material that is adapted to be adjustably connected to the shoulder pads 6. In particular the strap 49 is circular or a loop and passes in front of, through and behind a portion of the shoulder pads 6. The illustrated adjustment strap 49 includes a buckle 52 through which a free end 53 of the strap 49 projects to allow a person to pull on or release the strap 49 at the buckle 52 to consequently adjust the length of the strap 49 and the position of the pad 10.

Figure 8:
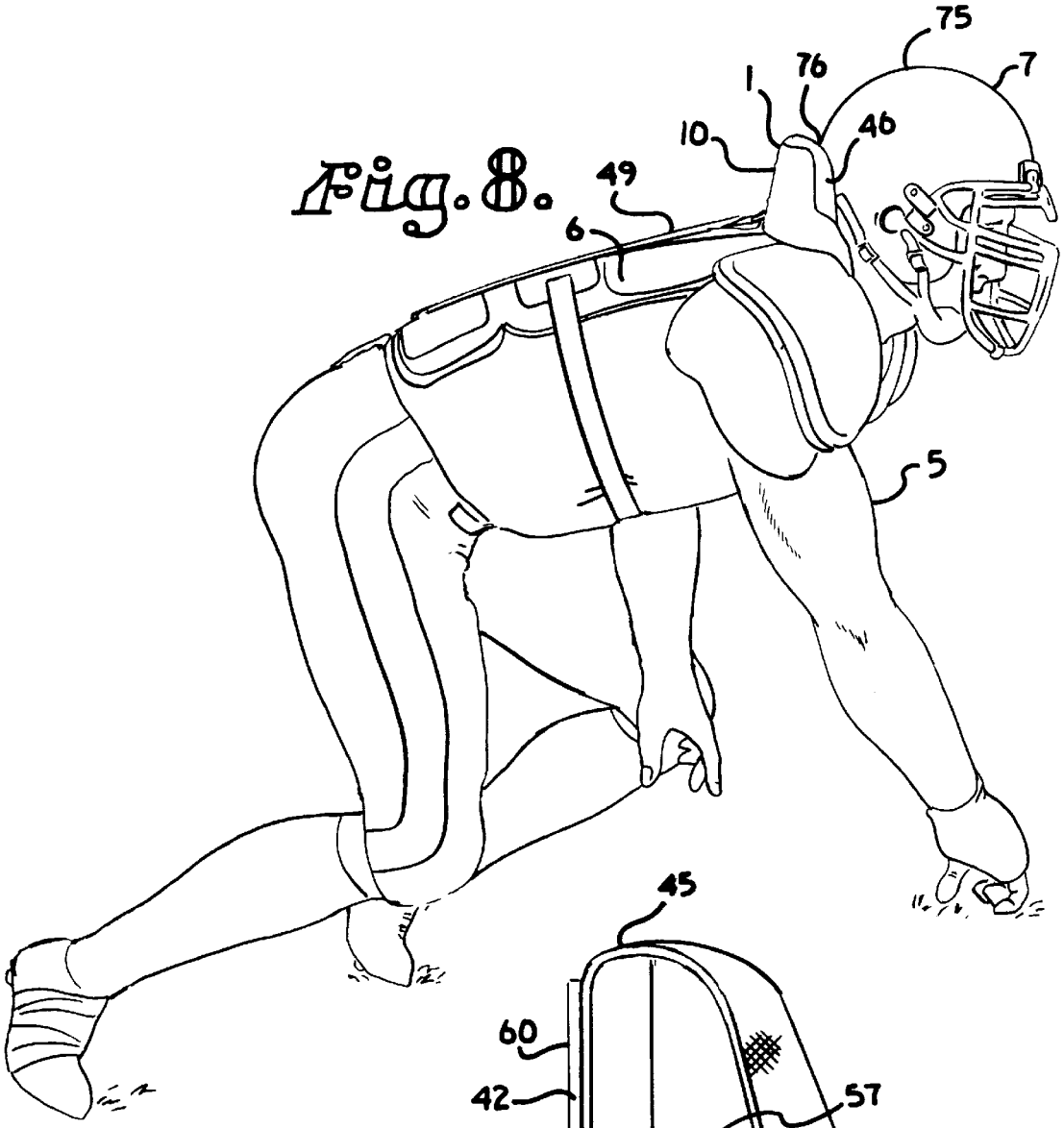
FIG. 8 is a side elevational view of a player wearing the collar apparatus, the shoulder pads and the helmet with a support pad of the collar drawn back to give the player better viewing from a down position.

Adjustment of the strap 49 allows the pad 10 to be swung or tilt about the base thereof between a generally upright position (see FIG. 6 where the pad 10 is comparatively upright) and a rearward position (see FIG. 8 where the pad is swung rearwardly at the top compared to the player 5). This adjustment allows the pad 10 to be better positioned for the player using the apparatus 1. For example, a down lineman may have the pad 10 somewhat back so the user can tilt their head further back for vision, as in FIG. 8, whereas a linebacker may have the pad 10 comparatively more upright, as in FIG. 6, since such a player normally does not have to get into a 3-point stance. It is foreseen that the adjustment strap 49 may be constructed from other materials such as laces, rope or the like.

Figure 9:
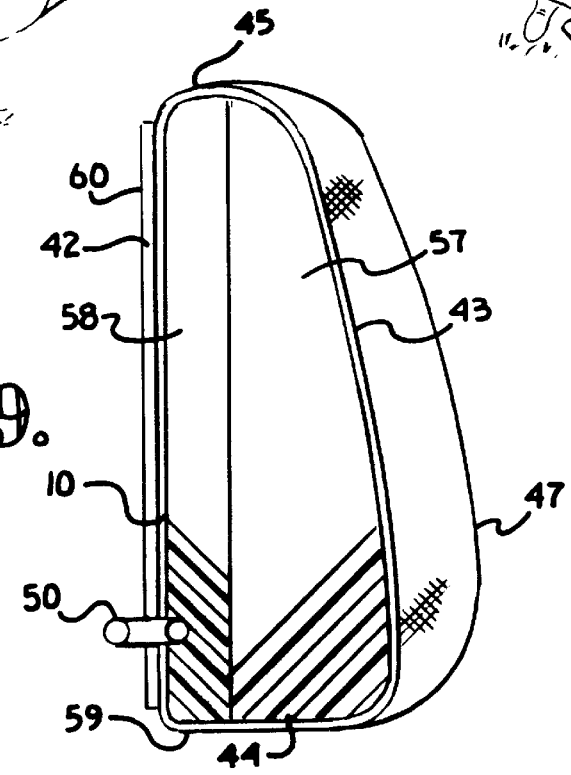
FIG. 9 is an enlarged, cross-sectional view of the support pad, taken along lines 9—9 of FIG. 5.

The construction of the protective pad 10 is best seen in FIG. 9. The protective pad includes an interior layer 57 of relatively soft foam which is positioned closest to the player 5 when in use backed by a layer 58 of relatively stiff hard foam. The layers 57 and 58 are surrounded by a fabric layer 59. In addition a stiff fabric layer 60 is secured to the rear of the pad 10.

The connective straps 12 and 13 join the pad 10 to the vest 11. The straps 12 and 13 are constructed of flexible fabric and are stitched to both the edge fabric strip 33 and the stiff fabric layer 60 at the rear of the pad 10. The straps 12 and 13 extend from near lower sides or corners of the pad 10. The straps 12 and 13 are generally not stretchable to any significant amount and hold the pad 10 in proper protective position when the vest 11 is properly located. However, if the vest 11 rides upwardly due to a hit by another player in the region of the torso 16, the straps 12 and 13 are sufficiently flexible such that the straps 12 and 13 do not transmit the upward movement. That is, the straps 12 and 13 pull frontwardly and downwardly to hold the pad 10 in position, but collapse and do not urge the pad 10 in the opposite direction, when the vest 11 raises.

Shown in FIGS. 6, 7 and 8 is the interaction between the collar apparatus 1, the shoulder pads 6 and helmet 7. The illustrated shoulder pads 4 are conventional and include a rear set of plates 63, 64, 65 and 66 and a pair of shoulder plates 69 and 70 all joined by connecting straps 71 and laces 72. A pair of adjustable side straps 73 and 74 also join the plates 64 and 68.

The pad adjustment strap 49 is operably looped under the shoulder pads plate 65. As with connecting straps 12 and 13 the adjustment strap 49 is flexible and collapses, if the shoulder pads 6 are driven upwardly, so that the pad 10 is not driven into the player's neck or under the helmet 7 by upward movement of the shoulder pads 4.

The helmet 7 is of a conventional type having a relatively smooth and curved outer surface 75. A lower rearward portion 76 of the surface 75 is opposed to the pad front surface 43 and received therein when the helmet 7 moves rearwardly relative to the player's torso 16. In particular, the helmet surface 76 is cradled in the pad front surface 43, when the player's head 79 is driven rearwardly by a blow. The pad 10 helps to lock the helmet 7 in a face forward position when the head is driven to the side or backwards and to the side by a blow to reduce the likelihood or risk of injury due to over flexure of the neck to both the rear and/or either side.

While the adjustment strap 49 is shown secured to the shoulder pads 6 in the illustrated embodiment, it is foreseen that it could be secured to the vest 11 or some other body or torso anchored structure.

In use the collar apparatus 1 is positioned with the vest 11 placed on an snuggled to the player's torso 16. The shoulder pads 6 and helmet 7 are then placed in a normal manner on the player 5. The adjustment strap 49 is looped about the shoulder pad plate 65 and tightened to best position the tilt of the protective pad 10 for the particular player 5, based upon the game position played and comfort of the player 5. In a more rearward position of the pad 10, as seen in FIG. 8, the player 5 is able to tilt the helmet 7 further rearward for better vision. In a more frontward position, as seen in FIG. 6, the player 5 has less head movement, but somewhat better protection as compared to the more rearward position. The collar apparatus 1 limits range of motion of the head and neck to reduce the likelihood of a user incurring hyperextension with or without hyper side flexion of the neck or of the user reinjuring a previously received injury. The collar apparatus 1 surrounds the back and sides of the helmet 7, when urged rearwardly or sidewardly to limit range of motion of the neck and head of the user 5. The collar apparatus 1 is held in a range of motion limiting position by the straps 12 and 13 that are joined to the vest 11.

It is also noted that the straps 12 and 13 may be different in length for different collar apparatuses 1 so as to best fit players of different size to prevent neck injuries or burners. A trainer can either select a collar apparatus 1 having straps 12 and 13 of a length best suited to treating or preventing neck injuries or burners in different players.

It is to be understood that while certain forms of the present invention have been illustrated and described herein, it is not to be limited to the specific forms or arrangement of parts described and shown.

What is claimed and desired to be secured by letters patent is as follows:

1. A protective collar apparatus for athletes wearing shoulder pads comprising:

a) a protective pad sized and shaped to be positioned behind the neck of a user;

b) a torso vest sized and shared to be secured to the body of a player and being independent of and not secured to the shoulder pads during usage; and c) a pair of connecting straps connecting opposite sides of said protective pad to said vest.

2. The apparatus according to claim 1 wherein:

a) said connecting straps are generally non stretchable but flexible so as to allow said vest to resist movement of said pad when forces are applied to said pad, but to not cause movement of said pad due to said vest being moved upwardly.

3. The apparatus according to claim 1 wherein:

a) said straps are secured to said pad near a lower end of outer sides of said pad.

4. The apparatus according to claim 1 including:

a) an adjustment strap connected to said pad; said adjustment strap being sized, shaped and positioned to operably be connected near a lower end of the adjustment strap to a torso mounted structure and being adjustable to position tilt of said pad at an upper end thereof.

5. The apparatus according to claim 1 wherein:

a) said pad is C-shaped so as to sized and shaped to cradle a helmet of a player during usage and has a greater thickness at the bottom thereof than at a top thereof.

6. A protective collar apparatus for an athlete wearing shoulder pads comprising:

a) a protective pad positioned behind the neck of a user to cushion blows and resist hyperextension and lateral side flexion of the user's neck;

b) an anchor structure sized and shaped be mounted on a user's torso during usage and being structurally independent of and not secured to the shoulder pads during use;

c) a pair of left and right connecting straps joining said pad to said anchor structure; and d) an adjustment strap secured to a rear of said pad and sized, shaped and positioned to be connected to a torso supported structure during usage; said adjustment strap operably positioning tilt of said pad as said pad pivots about the juncture of said pad with said connecting straps.

7. The apparatus according to claim 6 wherein:

a) said connecting straps are generally non stretchable but flexible.

8. The apparatus according to claim 7 wherein:

a) said adjusting strap is elongate and sized and shared to operably be secured to the shoulder pads.

9. A protective collar apparatus for athletes comprising:

a) a protective pad sized and shaped to be positioned behind the neck of a user during use;

b) a torso vest sized, shaped and positioned to be secured to the body of a player during use; and c) a pair of connecting straps connecting opposite sides of said protective pad to said vest; said connecting straps being generally non stretchable but flexible so as to allow said vest to resist movement of said pad when forces are applied to said pad, but to not cause movement of said pad due to said vest being moved upwardly.

10. A protective collar apparatus for athletes comprising:

a) a protective pad sized and shaped to be positioned behind the neck of a user;

b) a torso vest sized and shaped to be secured to the body of a player during usage;

c) a pair of connecting straps connecting opposite sides of said protective pad to said vest; and d) said pad being C-shaped so as to be sized and shaped to cradle a helmet of a player during use and has a greater thickness at the bottom thereof than at a top thereof; said pad having a front section and a rear section; said front section being constructed of a comparatively soft foam and the rear section being constructed of a comparatively stiff material.

11. A protective collar apparatus for athletes comprising:

a) a protective pad sized and shaped to be positioned behind the neck of a user;

b) a torso vest sized and shaped to be secured to the body of a player during use; and c) a pair of connecting straps connecting opposite sides of said protective pad to said vest; said straps being constructed of a fabric material and being stitched to said pad and said vest.

12. A protective collar apparatus comprising:

a) a protective pad positioned behind the neck of a user to cushion blows and resist hyperextension and lateral side flexion of the user's neck;

b) an anchor structure sized and shaped to be mounted on a user's torso during use;

c) a pair of left and right connecting straps joining said pad to said anchor structure;

d) an adjustment strap secured to a rear of said pad and sized and shaped to be connected to a torso supported structure; said adjustment strap operably positioning tilt of said pad as said pad pivots about the juncture of said pad with said connecting straps; and e) said pad being not directly joined to said anchor structure, but being connected only by said connecting straps.

13. A protective collar apparatus comprising:

a) a protective pad positioned behind the neck of a user to cushion blows and resist hyperextension and lateral side flexion of the user's neck;

b) an anchor structure sized and shaped to be mounted on a user's torso during use;

c) a pair of left and right connecting straps joining said pad to said anchor structure; said connecting straps being generally non stretchable but flexible; said connecting straps being constructed of a fabric material and being joined to both said pad and said anchor structure by stitching; and d) an adjustment strap secured to a rear of said pad and being sized and shaped to be connected to a torso supported structure during usage; said adjustment strap operably positioning tilt of said pad as said pad pivots about the juncture of said pad with said connecting straps.

14. In a protective collar apparatus for protecting athletes and having a pad sized and positioned to fit behind the neck of the user and to support the head of the user; the improvement comprising:

a) a pair of connecting straps joined at a first end thereof to said Dad near a lower end of said pad; said straps operably being securable at a second end thereof to a torso worn structure;

b) said pad being position adjustable and elongate; said pad having an upper end that is rotatable about an axis passing through a juncture of each of said connecting straps with said pad; and c) an adjustment strap joined at a first end thereof to said pad in spaced relationship to said connecting straps and being sized and shaped to be operably securable at a second end thereof to torso worn structure; said adjustment strap being adjustable in length to rotate and selectively position said pad about the axis passing through said juncture of said connecting straps with said pad.

15. In a protective collar apparatus for protecting athletes and having a pad sized and positioned to fit behind the neck of the user and to support the head of the user; the improvement comprising:

a) a connecting strap joined at a fast end thereof to said pad near a lower end of said pad; said strap operably being securable at a second end thereof to a torso worn structure;

b) said pad being position adjustable and elongate; said pad having an upper end that is rotatable about an axis passing through a juncture of said connecting strap with said pad; and c) an adjustment strap joined at a first end thereof to said pad in spaced relationship to said connecting strap and being sized and shaped to be operably securable at a second end thereof to torso worn structure; said adjustment strap being adjustable in length to rotate and selectively position said pad about the axis passing through said juncture of said connecting strap with said pad.

* * * * *